US009694233B2

(12) United States Patent
Chou

(10) Patent No.: US 9,694,233 B2
(45) Date of Patent: Jul. 4, 2017

(54) WEIGHT BAR LOCKING MECHANISM

(71) Applicant: Cheng I Chou, City of Industry, CA (US)

(72) Inventor: Cheng I Chou, City of Industry, CA (US)

( * ) Notice: Subject to any disclaimer, the term of this patent is extended or adjusted under 35 U.S.C. 154(b) by 0 days.

(21) Appl. No.: 15/001,532

(22) Filed: Jan. 20, 2016

(65) Prior Publication Data

US 2016/0213966 A1 Jul. 28, 2016

Related U.S. Application Data

(60) Provisional application No. 62/107,154, filed on Jan. 23, 2015.

(51) Int. Cl.

| | |
|---|---|
| ***A63B 21/06*** | (2006.01) |
| ***A63B 21/078*** | (2006.01) |
| ***A63B 71/00*** | (2006.01) |
| *A63B 21/072* | (2006.01) |

(52) U.S. Cl.

CPC ..... *A63B 21/0783* (2015.10); *A63B 71/0036* (2013.01); *A63B 21/0724* (2013.01)

(58) Field of Classification Search

USPC ..... 482/1–148

See application file for complete search history.

(56) References Cited

U.S. PATENT DOCUMENTS

| | | | | |
|---|---|---|---|---|
| 3,552,748 | A * | 1/1971 | Thomas | A63B 5/02 482/16 |
| 4,616,798 | A * | 10/1986 | Smeenge | A47B 21/0314 108/69 |
| 4,822,034 | A * | 4/1989 | Shields | A63B 21/072 482/106 |
| 4,982,957 | A * | 1/1991 | Shields | A63B 21/0728 482/104 |
| 5,123,885 | A * | 6/1992 | Shields | A63B 21/0728 482/106 |
| 5,281,193 | A | 1/1994 | Colbo, Jr. | |
| 5,529,270 | A * | 6/1996 | Liu | A47C 17/68 248/166 |
| 5,727,764 | A | 3/1998 | Angeles | |
| 6,063,014 | A | 5/2000 | Scoggins | |
| 6,409,127 | B1 * | 6/2002 | VanderHeide | A47B 21/0314 108/93 |
| 6,447,433 | B1 | 9/2002 | Reyes | |

(Continued)

*Primary Examiner* — Stephen R Crow

(74) *Attorney, Agent, or Firm* — Kirk A. Buhler; Buhler & Associates

(57) ABSTRACT

Improvements in a weight bar locking mechanism that secures a zig-zag or bent curling bar or straight bar. Curl bars have only limited areas where the bar can be rested where the bar is perpendicular to the weights. The central area is typically fairly narrow in dimension and placing the curl bar on this central area can be difficult and is the bar is not placed into the central area the curl be can be unbalanced. The locking mechanism captures both the top and bottom of the curl bar to lock the bar and prevents the curl bar from falling if the curl bar is not properly placed onto the locking mechanism. The locking mechanism forces the retained sides of the curl bar like an over-center torsion bar type arrangement to forces both sides of the curl bar to be essentially parallel orientation.

20 Claims, 4 Drawing Sheets

(56) References Cited

U.S. PATENT DOCUMENTS

| | | | | |
|---|---|---|---|---|
| 6,679,816 | B1 * | 1/2004 | Krull | A63B 21/075<br>482/107 |
| 6,874,744 | B2 * | 4/2005 | Rawlings | F16M 11/041<br>248/130 |
| 7,708,251 | B2 | 5/2010 | Watt et al. | |
| 8,974,354 | B1 * | 3/2015 | Nelson | A63B 21/08<br>482/94 |
| 9,044,643 | B2 * | 6/2015 | Staten | A63B 21/078 |
| 9,248,335 | B2 * | 2/2016 | Reyes | A63B 21/078 |
| 9,597,539 | B2 * | 3/2017 | Grider | A63B 17/04 |
| 2002/0142893 | A1 | 10/2002 | Koenig | |

* cited by examiner

WEIGHT BAR LOCKING MECHANISM

CROSS REFERENCE TO RELATED APPLICATION

This application claims the benefit of Provisional Application Ser. No. 62/107,154 filed Jan. 23, 2015 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in an apparatus used with free weights. More particularly, the present weight bar locking mechanism creates a locking mechanism that helps maintain a bar in a parallel relationship to the ground and prevents the weight from being unintentionally displaced.

Description of Related Art Including Information Disclosed under 37 CFR 1.97 and 1.98

Many people exercise using weights to increase their strength, for general conditioning and or for rehabilitation. While some strength training equipment use cables or other resistance means, there are still a large number of people that prefer to use free weights connected with a rod. Some exercises use a straight rod while others use a curl bar that can take a variety of spline shaped bends that allow the wrists of the person lifting the weight to be in a more natural pronate or supination position.

Because the curl bar includes multiple bends, the bar is often difficult to balance when the curl bar is placed in or on a stanchion. While the curl bar can be placed on supports placed near the weights, in use a person performing lifts of a weight bar generally leans forward and lifts the weight from a central location where balancing the curl bar on a narrow support can be difficult. A number of patents and or publications have been made to address these issues. Exemplary examples of patents and or publication that try to address this/these problem(s) are identified and discussed below.

U.S. Pat. No. 5,727,764 issued on Mar. 17, 1998 to James P. Angeles discloses a Self-Locking Quick Release Bracket. The bracket pieces are separate and are located on separate stanchions. The locking mechanism on each stanchion retains the weight at an extreme end where the weights are secured to the lifting bar. This patent does not provide a locking mechanism that is located at the center of the bar where a user places and lifts the curl bar. The locking bar simply holds the weight to prevent the weight from being accidentally knocked off the stanchion. The bracket is tilted to remove the weight from the bracket.

U.S. Pat. No. 6,447,433 issued on Sep. 10, 2002 to Gilbert Reyes discloses a Weight-Bar Support Structure with Retractable Arms. As the weight is removed the arms retract to allow the weight to be lifted from the support structure. Without lifting the bar, the weight can't be removed from the support structure. The support structure is also located at the opposing ends of the lifting bar as opposed to being located in the center between the weight plates. This patent requires movement or sliding of the bar to remove the bar from the support structure as opposed to a locking mechanism that is rotated to allow the bar to be lifted or removed from a central position.

What is needed is a weight bar locking mechanism that retains the curl bar or straight bar in a horizontal locked position until the lock is released to allow a user to exercise. Once the exercise is complete the curl bar or straight bar is placed onto the locking mechanism where the curl bar or straight bar is retained and locked against accidental dislodging.

BRIEF SUMMARY OF THE INVENTION

It is an object of the weight bar locking mechanism to operate with a curling bar or straight bar. A curling bar typically has a unique zig-zag or bent configuration that allows a person to grip the bar with a more natural rotation of the wrists of the person who is exercising. Curl bars have only limited areas where the bar can be rested when the bar is perpendicular to the weights that are placed on the ends of the curl bar.

It is an object of the weight bar locking mechanism for the locking mechanism to retain a curl bar in the central portion of the curl bar that is concentric with the weights placed on the ends of the curl bar. The central area is typically fairly narrow in dimension and placing the curl bar on this central area can be difficult and if the bar is not placed near a central location of the curl bar, the curl bar can be unbalanced. The locking mechanism captures both the top and bottom of the curl bar to lock the bar and prevents the curl bar from falling if the curl bar is not properly placed onto the locking mechanism.

It is another object of the weight bar locking mechanism to lock the curl bar with an over-center mechanism. As a curl bar is placed onto the locking mechanism the mechanism flips from an open condition to a locked position as the curl bar is retained in a holder with a locking mechanism that retains the curl bar in a pinched keeper that both centers and retains the curl bar.

It is still another object of the weight bar locking mechanism to retain the curl bar in a parallel structure that prevents one side of the curl bar from tipping off of the locking mechanism. The locking mechanism forces the retained sides of the curl bar in a torsion bar type arrangement that forces both sides of the curl bar to be essentially parallel with the horizon.

Various objects, features, aspects, and advantages of the present invention will become more apparent from the following detailed description of preferred embodiments of the invention, along with the accompanying drawings in which identifying numbers are used to identify components.

BRIEF DESCRIPTION OF THE SEVERAL VIEWS OF THE DRAWING(S)

DETAILED DESCRIPTION OF THE INVENTION

Figure 1:
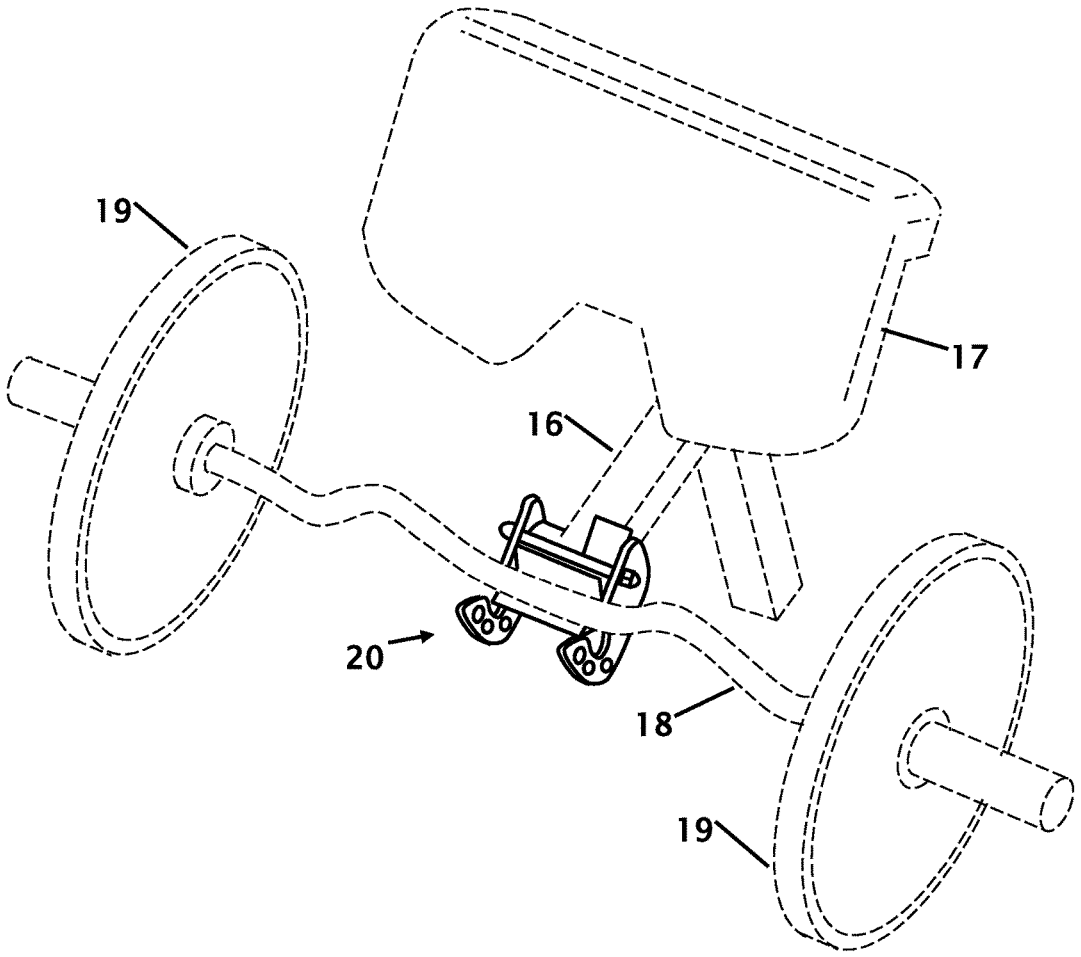
FIG. 1 shows a perspective view of a weight bar locking mechanism with a curl bar.

FIG. 1 shows a perspective view of a weight bar locking mechanism 20 with a curl bar 18. This figure is a typical configuration where a user would kneel or sit into the weight lifting apparatus and place their arms onto the pad 17. A horizontal or level post 16 supports the locking mechanism 20. A weight bar 18 is shown having a bent curved configuration with weights 19 placed at the ends of the weight bar 18. The locking mechanism 20 supports the weight bar 18 at the narrow concentric portion of the curling bar that both retains and balances the curling bar 18 on the horizontal or level post 16. A user unlocks and dislodges the weight bar 18 from the locking mechanism to exercise. Once the user completes the exercise, the user places the weight bar 18 into the locking mechanism 20 where the weight bar is retained and is prevented from being accidentally dislodged.

Figure 2:
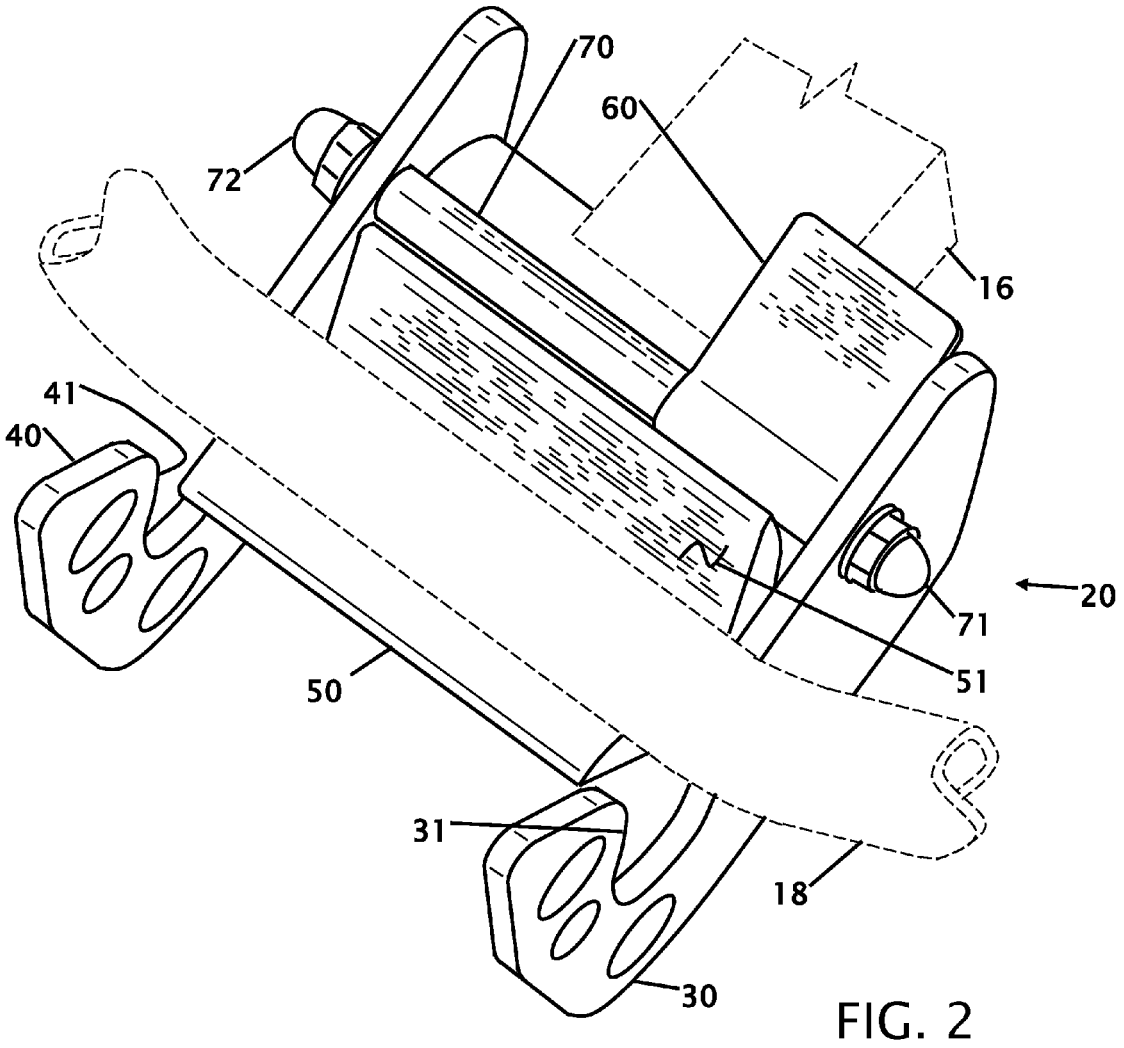
FIG. 2 shows a detailed view of the weight bar locking mechanism.

FIG. 2 shows a detailed view of the weight bar locking mechanism 20 on a mounting post 16. This detailed view shows the weight bar 18 as it is being placed into the locking mechanism. As the weight bar 18 is being inserted, the weight bar 18 engages onto the front face of front flapper 50. The weight bar 18 must be horizontally aligned within the upper jaws 31/41 and the lower jaws 32/33 (not visible in this figure) to the left and right plates 30/40 respectively. As the weight bar is placed into the locking mechanism 20 the front face of the front flapper 50 flips over and the lower face 51 to cover the opposing side of the weight bar 18. The locking tab 60 rotates manually into a locking notch (not visible in this view) to retain the flapper 50/51. The flapper 50/51 and the locking tab 60 are separately retained by separate bolts 70 (Not visible in this figure) or shoulder bolts. Nuts or acorn nuts 71/72 are secured onto one or both sides of the bolts or shoulder bolts 70. A spring (not visible in this figure) retains the flapper 50/51 in an open condition. Springs are located at one or more sides of the locking mechanism 20 between the flapper 50/51 and the side plates 30/40. While a spring is disclosed the flapper can be weighted such that the flapper will naturally self-orient to lock the weight bar 18.

Figure 3:
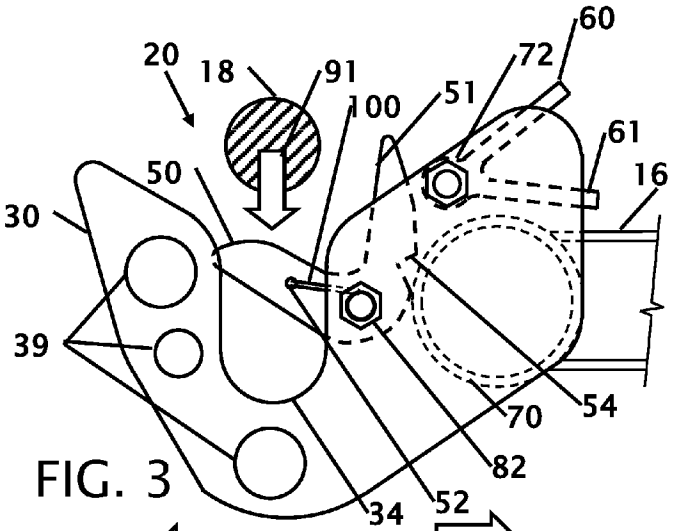
FIG. 3 shows a first view of the weight bar locking mechanism with a curl bar entering into the locking mechanism.

FIG. 3 shows a first view of the weight bar locking mechanism with a curl bar 18 entering 91 into the locking mechanism. Torsion spring 100 shown engaged in hole 52 to maintain the front flapper 50 in the open configuration shown in this figure. The weight bar is moved into the front flapper 50 through the parallel slots in the side plates 30 and 40 (not shown). The locking tabs 60 is shown rotated away from the front flapper 50. Holes 39 provide cosmetic styling and lightening of the side plate 30. Screws, bolts or pivoting axis 82 allow the front flapper 50 to rotate, while screw, bolt or pivoting axis 72 allow the rear flapper to rotate. The weight bar locking mechanism 20 is mounted, bolted, welded or otherwise secured to the frame 16 and or a cross tube 70 to support both the weight bar locking mechanism 20 and the weight bar 18 with weights.

Figure 4:
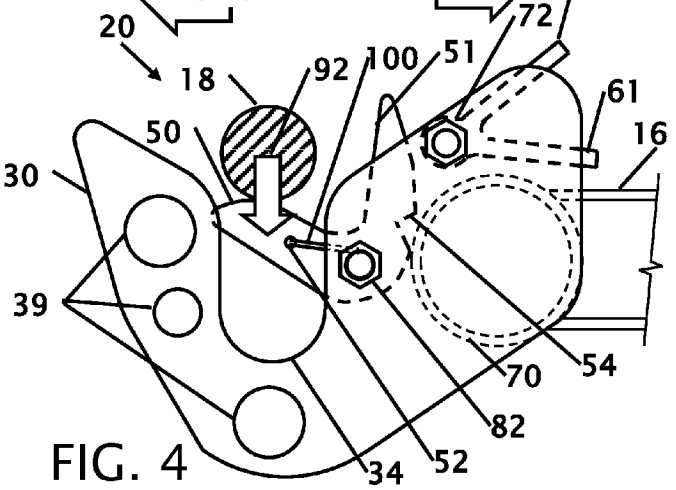
FIG. 4 shows a second view of the weight bar locking mechanism with a curl bar entering into the locking mechanism.

FIG. 4 shows a second view of the weight bar locking mechanism 20 with a curl bar entering into the locking mechanism. As the weight bar 18 is pushed into the weight bar locking mechanism 20, the front flapper 50 moves 92 or rotates.

Figure 5:
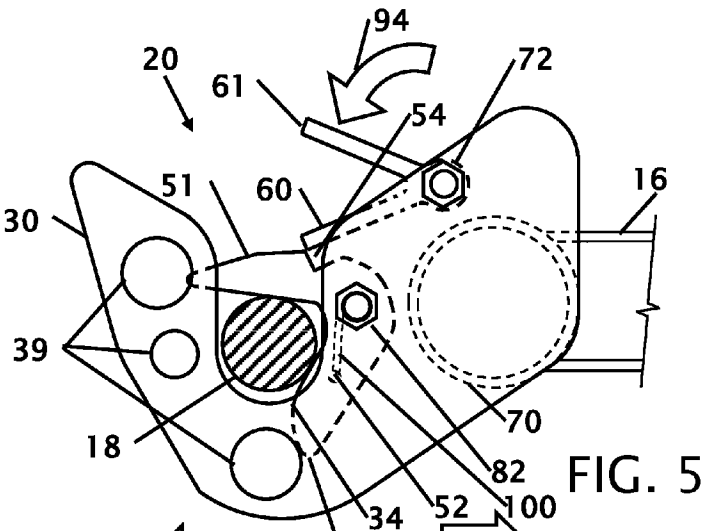
FIG. 5 shows a third view of the weight bar locking mechanism with a curl bar being initially locked.

FIG. 5 shows a third view of the weight bar locking mechanism 20 with a curl bar 18 being initially locked. Once the weight bar is completely placed into the weight bar locking mechanism 20, a lower face of the front flapper 51 on the front flapper 50 prevents the weight bar from being withdrawn. The second safety locking tabs 60 and 61 can be manually flipped to ensure that the lower face of the front flapper 51 will not open. This essentially locks the weight bar 18 into a box within the weight bar locking mechanism 20.

Figure 6:
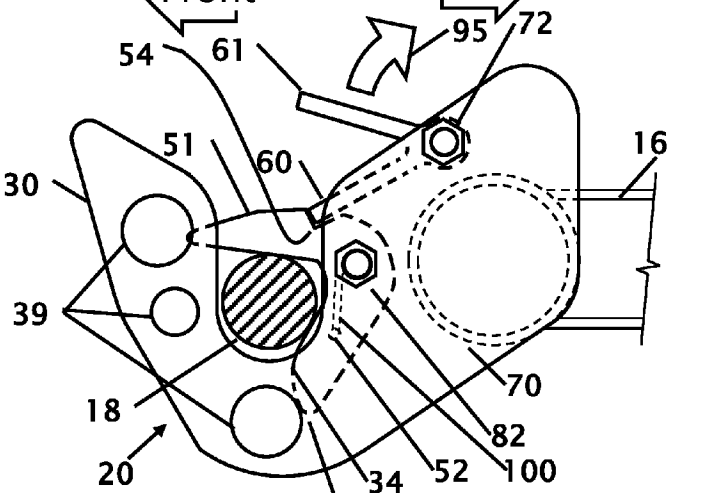
FIG. 6 shows a fourth view of the weight bar locking mechanism with a curl bar completely locked and how to unlock and remove the curl bar.

FIG. 6 shows a fourth view of the weight bar locking mechanism 20 with a curl bar 18 completely locked. Removal of the weight bar is accomplished when the rear flapper is pulled open by pulling on the arm 61 of the rear flapper to disengage the arm of the locking tab 60 from the lower face of the front flapper 51 in the front flapper 50. The weight bar 18 can then be withdrawn from the weight bar locking mechanism 20.

Figure 7:
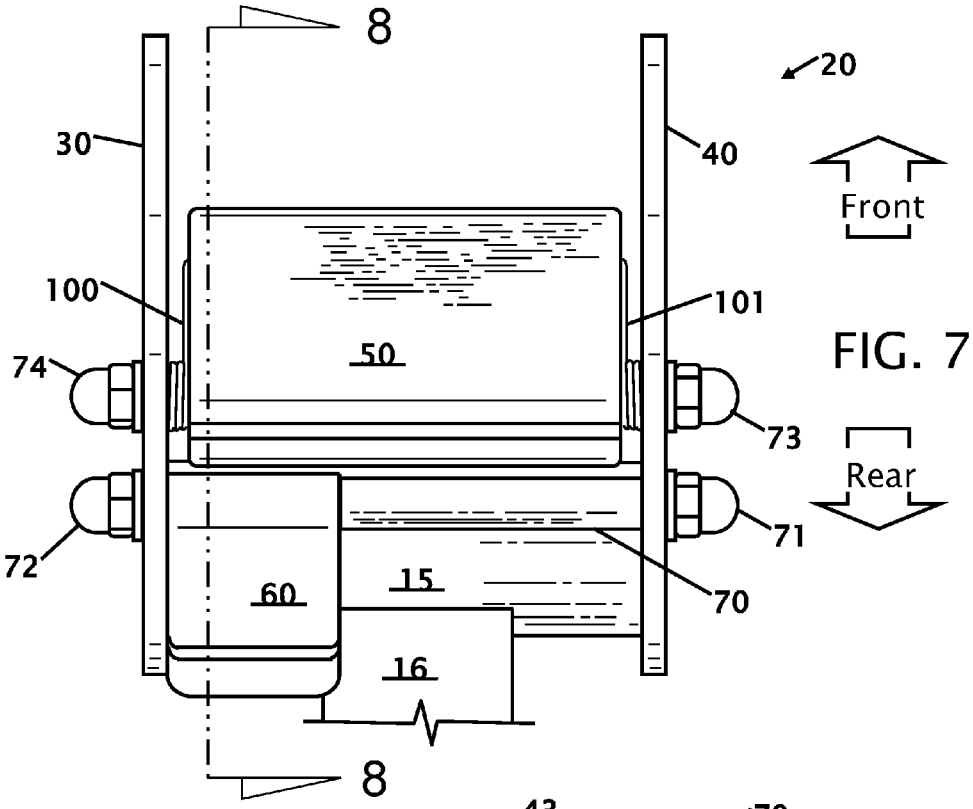
FIG. 7 shows a top view of the weight bar locking mechanism.

FIG. 7 shows a top view of the weight bar locking mechanism 20. Nuts or acorn nuts 71-74 secure the ends of the pivoting front flapper 50 and the locking tab 60. Torsion springs 100 and 101 are shown on each side of the front flapper 50. The two parallel side plates 30 and 40 are shown secured to the frame 16 and cross pipe 15.

Figure 8:
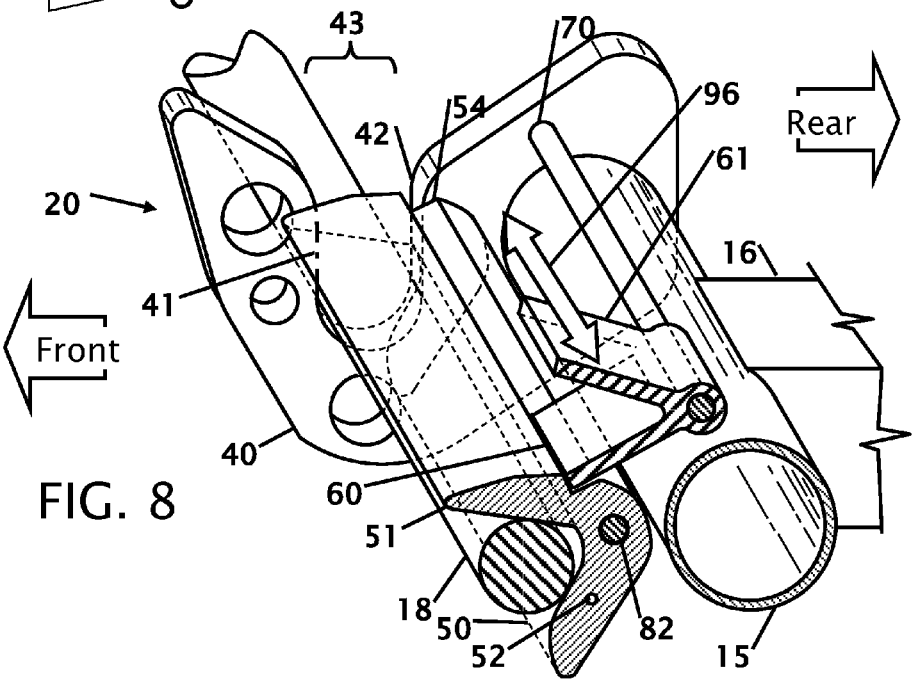
FIG. 8 shows a perspective sectional view of the weight bar locking mechanism of FIG. 7 cut through section 8-8.

FIG. 8 shows a perspective sectional view of the weight bar locking mechanism cut through section 8-8 of FIG. 7. The weight bar locking mechanism 20 has a pair of parallel placed sides 40 and 30 (30 not shown in this view). The said parallel placed sides 30 and 40 are rigidly joined together with cross pipe 15. The cross pipe 15 is secured to horizontal or level pipe 16. While a particular arrangement of pipes is shown to mount and/or secure the weight bar locking mechanism 20, various other embodiments are contemplated to secure the weight bar locking mechanism 20.

The parallel placed sides 30 and 40 each having a slot 43 is formed with a front surface 41 and a rear surface 42 is sized to accept a rod or tube member 18. The rod member 18 is a weight bar or other type shaft. Between the parallel placed sides 30, 40 is a front flapper 50 having at least two arms that are connected through a first common pivot 82. Between the parallel placed sides 30, 40 is a locking tab 60 that has at least one arm that is connected through a second pivot 70. The front flapper 50 has at least one arm with a step 54 and at least one locking tab 60. The locking tab 60 engages into the step 54 to prevent the front flapper 50 from rotating on the first common pivot 82.

The weight bar locking mechanism 20 further including at least one spring 100, 101 (shown in FIG. 7) that is engaged on the first flapper 50 in hole 52 to favor rotation of the first flapper 50 in a first direction of rotation on the first common pivot 82. In the preferred embodiment, the second flapper has two arms 60, 61 where the first arm engages in the slot 54, and the second arm provides access for a user to dislodge the first arm from the slot 54.

Thus, specific embodiments of a weight bar locking mechanism have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A weight bar locking mechanism comprising:

a pair of parallel placed surfaces;

said parallel placed surfaces are rigidly joined together;

said parallel placed surfaces each having a slot sized to accept a weight bar;

between said parallel placed surfaces is a first flapper having at least two arms connected through a first common pivot;

between said parallel placed surfaces is a second flapper having at least one arm connected through a second pivot, and said first flapper having at least one of said two arms having a step where said at least one arm of said second flapper engages into said step to prevent said first flapper from rotating on said first common pivot.

2. The weight bar locking mechanism according to claim 1 further including at least one spring engaged on said first flapper to rotate said first flapper in a first direction of rotation on said first common pivot.

3. The weight bar locking mechanism according to claim 1 wherein said first flapper is weighted to orient said first flapper.

4. The weight bar locking mechanism according to claim 1 wherein said weight bar is a curling bar, straight bar or barbell.

5. The weight bar locking mechanism according to claim 1 wherein said second flapper includes at least one arm.

6. The weight bar locking mechanism according to claim 5 wherein said second flapper includes at least two arms having an acute angle between the at least two arms.

7. The weight bar locking mechanism according to claim 1 wherein said two arms on said first flapper have an acute angle.

8. The weight bar locking mechanism according to claim 7 wherein said weight bar is retained in sides of said acute angle.

9. The weight bar locking mechanism according to claim 1 wherein said pair of parallel placed surfaces are made from metal.

10. The weight bar locking mechanism according to claim 1 wherein said first flapper is made of plastic.

11. The weight bar locking mechanism according to claim 1 wherein said second flapper is made of plastic.

12. The weight bar locking mechanism according to claim 1 wherein when said at least one arm is rotated out of said step to remove said weight bar.

13. The weight bar locking mechanism according to claim 1 wherein said weight bar rotates said first flapper when said weight bar is passed into said slot.

14. The weight bar locking mechanism according to claim 1 wherein said first flapper is biased with a spring.

15. The weight bar locking mechanism according to claim 14 wherein said spring biases said first flapper to accept said weight bar.

16. The weight bar locking mechanism according to claim 1 wherein said first common pivot is through a first shaft that connects between said parallel placed surfaces.

17. The weight bar locking mechanism according to claim 1 wherein said second pivot is through a second shaft that connects between said parallel placed surfaces.

18. The weight bar locking mechanism according to claim 1 wherein said parallel placed surfaces are connected with at least one member.

19. The weight bar locking mechanism according to claim 1 wherein said parallel placed surfaces are connected to a weight lifting apparatus.

20. The weight bar locking mechanism according to claim 1 wherein when said weight bar is engaged in said weight bar locking mechanism said weight bar is maintained in an essentially parallel relationship with a ground surface.

* * * * *